US011330901B2

(12) United States Patent
Mackall, II et al.

(10) Patent No.: US 11,330,901 B2
(45) **Date of Patent: *May 17, 2022**

(54) SAWHORSE SUPPORT AND TABLE

(71) Applicant: Leetes Island Woodworks, LLC, Guilford, CT (US)

(72) Inventors: Louis Mackall, II, Guilford, CT (US); Kenneth K. Field, Guilford, CT (US)

(73) Assignee: Leetes Island Woodworks, LLC, Guilford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/211,524

(22) Filed: Mar. 24, 2021

(65) Prior Publication Data

US 2022/0031063 A1 Feb. 3, 2022

Related U.S. Application Data

(63) Continuation of application No. 16/943,681, filed on Jul. 30, 2020, now Pat. No. 10,993,528.

(51) Int. Cl.

| | |
|---|---|
| ***A47B 13/00*** | (2006.01) |
| ***A47B 13/04*** | (2006.01) |
| ***B25H 1/06*** | (2006.01) |
| ***B25H 1/04*** | (2006.01) |

(52) U.S. Cl.

CPC ..... *A47B 13/003* (2013.01); *A47B 13/04* (2013.01); *B25H 1/04* (2013.01); *B25H 1/06* (2013.01)

(58) Field of Classification Search

CPC ..... A47B 13/003; A47B 13/04; B25H 1/04; B25H 1/06; F16M 13/00; Y10T 24/303; Y10T 24/309; F16B 9/00; F16B 9/09; F16B 9/023; F16B 9/05; F16B 9/07; F16B 12/44; F16B 12/48

USPC .... 108/153.1, 154, 155, 157.1, 157.16, 159, 108/158.13; 182/181.1; 248/440.1; 144/286.1, 386.5

See application file for complete search history.

(56) References Cited

U.S. PATENT DOCUMENTS

| | | | |
|---|---|---|---|
| 1,548,894 | A | 8/1925 | McLaughlin |
| 1,819,252 | A | 8/1931 | Linsner |
| 1,946,610 | A | 2/1934 | Bucholz |
| 2,149,665 | A | 3/1939 | Box |

(Continued)

FOREIGN PATENT DOCUMENTS

| | | | |
|---|---|---|---|
| DE | 4411394 | A1 | 10/1994 |
| DE | 19941772 | A1 | 3/2001 |

(Continued)

OTHER PUBLICATIONS

"Sawhorse Table", http://www.thissortaoldlife.com/wp-content/uploads/2013/03/RAW_1 314793_E_de.jpg, retrieved from internet on May 6, 2020.

(Continued)

*Primary Examiner* — Janet M Wilkens

(74) *Attorney, Agent, or Firm* — St. Onge Steward Johnston & Reens LLC

(57) ABSTRACT

A flat packaged support and table which can be assembled using through screw fasteners and interlocking structures to create a table and/or a support from flat stock such as plywood. The table when disassembled packs into a container which is less than 3 inches thick.

22 Claims, 16 Drawing Sheets

(56) References Cited

U.S. PATENT DOCUMENTS

| | | | | | |
|---|---|---|---|---|---|
| 2,343,557 | A * | 3/1944 | Erikh | B25H 1/06 | 182/186.1 |
| 2,686,096 | A | 8/1954 | Barnes | | |
| 3,396,933 | A | 8/1968 | Ward | | |
| 3,463,099 | A | 8/1969 | Doucette | | |
| 3,760,903 | A * | 9/1973 | Thompson | B25H 1/06 | 182/186.3 |
| 4,084,517 | A | 4/1978 | Guess | | |
| 4,181,292 | A | 1/1980 | Hubel | | |
| 4,260,040 | A | 4/1981 | Kieffer | | |
| 4,390,081 | A * | 6/1983 | Olmsted | B25H 1/06 | 182/151 |
| 4,400,043 | A | 8/1983 | Rossow | | |
| 5,101,932 | A | 4/1992 | Trudgeon | | |
| 5,193,598 | A | 3/1993 | Estrem | | |
| 5,265,697 | A * | 11/1993 | Quick | B25H 1/06 | 182/151 |
| 5,482,096 | A * | 1/1996 | Russell | B23Q 35/101 | 144/144.51 |
| 5,518,082 | A | 5/1996 | Liao | | |
| 5,848,852 | A * | 12/1998 | Shpigel | A47B 13/04 | 403/219 |
| 6,024,024 | A | 2/2000 | Favaretto | | |
| 6,615,746 | B2 | 9/2003 | Bart | | |
| 7,048,021 | B2 * | 5/2006 | Ayala | B23D 47/025 | 144/286.1 |
| 8,167,011 | B2 | 5/2012 | Quiram et al. | | |
| 9,332,838 | B1 | 5/2016 | Kilday et al. | | |
| 10,463,146 | B1 | 11/2019 | Bravo | | |
| 2001/0055514 | A1 | 12/2001 | Muhlen | | |
| 2003/0051769 | A1 | 3/2003 | Welsh et al. | | |
| 2004/0069913 | A1 * | 4/2004 | Martens | B25H 1/06 | 248/161 |
| 2006/0042523 | A1 | 3/2006 | Chang | | |
| 2008/0035427 | A1 * | 2/2008 | Fowler | B25H 1/06 | 182/153 |
| 2009/0272861 | A1 | 11/2009 | Bevelacqua | | |
| 2011/0240404 | A1 | 10/2011 | Woodard | | |
| 2015/0164224 | A1 | 6/2015 | Kemp | | |
| 2021/0219712 | A1 * | 7/2021 | Gold | A47B 13/003 | |

FOREIGN PATENT DOCUMENTS

| | | | |
|---|---|---|---|
| DE | 102009036205 | A1 | 2/2011 |
| DE | 202010017070 | U1 | 3/2011 |
| DE | 102017125069 | A1 | 8/2018 |
| EP | 0345072 | A2 | 12/1989 |
| FR | 2059798 | A5 | 6/1971 |
| FR | 2862503 | A1 | 5/2005 |
| FR | 2965707 | A1 | 4/2012 |
| FR | 2993944 | A1 | 1/2014 |
| GB | 295644 | A | 8/1928 |
| GB | 2223441 | * | 4/1990 |
| WO | 2016083386 | A1 | 6/2016 |
| WO | 2018215909 | A1 | 11/2018 |

OTHER PUBLICATIONS

"Sawhorse Table", http://www.yvonnemouser.com/sawhorse-table, retreived from Internet on May 6, 2020.

"Simple Knock Down Stool Made From Plywood (flat Pack)", https://www.instructables.com/id/Simple-knock-down-stool-made-from-plywood-flat-pa/, retrieved from Internet on May 5, 2020.

"Simple Knock-down Cardboard End Table (flat pack)", https://www.instructables.com/id/Simple-knock-down-cardboard-end-table-flatpack/, retrieved from Internet on May 5, 2020.

* cited by examiner

SAWHORSE SUPPORT AND TABLE

FIELD OF THE INVENTION

The following relates to a sawhorse, and a table top which has that sawhorse for its base. More particularly, the following relates to a sawhorse and table constructed from flat stock, such as solid wood or plywood. An ornamental design for the table is also disclosed.

BACKGROUND OF THE INVENTION

Furniture comes in many shapes and sizes. Pre-assembled furniture often comes at a higher price premium because labor costs to assemble the furniture are more and because shipping a fully assembled piece is more expensive. Many purchasers of furniture are price sensitive but also want an appealing design and a sturdy piece. Although many user-assembled furniture pieces exist, they often require numerous fasteners and screws which are threaded into wood. If done incorrectly, the structural integrity of the furniture can be compromised. In addition, the shipping/packaging size is often relatively large and thick which increases costs in shipping, warehousing and retail shelf space.

Therefore, there is a need for furniture which utilizes secure connections and also is self locking and supporting in design while at the same time being space efficient for shipping purposes.

SUMMARY OF THE INVENTION

It is therefore an object of the invention to provide a sturdy user-assembled furniture piece.

It is a further object of the invention to provide a furniture piece which can be shipped in small packaging.

It is further desirable for the wooden parts of the furniture piece to be all cut from the same stock, preferably flat stock such as plywood.

These and other objects are achieved by providing a flat packaged table which can be assembled using through screw fasteners and interlocking structures to create a table from flat stock. The table includes a sawhorse providing four legs connected to an elongated support or a stretcher. The legs of extend outwards and downwards at a compound angle of 15 degrees in each way (of the compound angle). This angle may be any angle in the range +/−5-10 degrees. A tabletop is provided to rest above the sawhorse and two table supports are connected to the underside of the tabletop in a recess. The recess has two internal facing edges which are tapered at an angle which is equal to that of the outside flat faces of the sawhorse legs. The internal facing edge of a support abuts the outwards facing leg surface at each leg. The outwards facing leg surface is arranged parallel to the longitudinal axis of the elongated support/stretcher. In addition, a clip is provided which is attached to the underside of the table in the same manner as the two table supports, but at the middle. This clip has flexible extensions which flex to grip the bottom edge of the stretcher/elongated support with hooks formed at their ends.

In one aspect the table includes an elongated support (stretcher) with a longitudinal axis and two parallel outward facing surfaces. A plurality of legs are connected to the elongated support and extend outwards and downwards at a first angle relative to one of the outward facing surfaces. A table top rests above the elongated support and the plurality of legs. A plurality of table supports are connected to the table top to define a recess with two internal facing edges which are outwardly tapered at a second angle which is substantially equal the first angle such that each internal facing edge abuts one of an outwards facing leg surface of one the legs, the outwards facing leg surface arranged parallel the longitudinal axis and the internal facing edges extending between first and second surfaces of the table support, the first and second surfaces being parallel and outward facing in opposite directions.

In certain aspects at least one hole extends through the elongated support and a recess in the elongated support is on each side of the at least one hole. The legs secure to the elongated supports with fasteners which pass through, in order, a hole in a first one of the legs, a first one of the at least one hole in the elongated support and a hole in a second one of the legs. Ends of the first and second legs are at least partially contained in recesses of the elongated support on opposite sides of the first one of the at least one hole in the elongated support (e.g. on opposite sides of the stretcher). In other aspects the at least one hole includes two holes spaced apart along the elongated support and the plurality of legs include third and fourth legs configured to secure to a second one of the two holes in the elongated support. The elongated support includes recesses located at the second one of the two holes, the recesses on either side of the second one of the two holes. The third and fourth legs secure to the elongated support with a fastener which passes through, in order, a hole in the third one of the legs, the second one of the two holes in the elongated support and a hole in the fourth one of the legs. Ends of the third and fourth legs are at least partially contained in recesses of the elongated support on opposite sides of the second one of the two holes in the elongated support.

In other aspects the ends of the first and second legs include angled faces which are positioned at an angle relative the outwards facing surface. The internal facing edge of one of the table supports which abuts the corresponding leg is provided at a second angle as well and the angle relative the outwards facing surface is equal to the second angle of the internal facing edge. In this manner, the internal facing edge of the table supports match and mate to the angled leg faces.

In still other aspects the table top further comprises a plurality of notches therein which extend at least partially into a bottom surface of the table top. A first one of the plurality of notches is aligned and sized to receive part of the elongated support therein. At least a second one of the plurality of notches is arranged transverse the first one of the plurality of notches and sized to receive at least part of one of the table supports therein along an outer edge of the table support. In still other aspects, the elongated support, plurality of legs, the plurality of table supports and the table top are made of wood, optionally plywood. In other aspects the recess of the plurality of table supports includes a flat upper edge and a flat lower edge parallel the upper edge, the flat lower edge is positioned between the internal facing edges such that the internal facing edges extend downward and away from the flat upper edge.

In certain preferred aspects, the underside of the table top contains three notches which provide for the female part of intermittent sliding dovetails made by tapered faces inside the notches. The top edge of the table supports and the top edge of the clip are provided with the male portion of the sliding dovetail or tapered portion. The intermittent sliding dovetail securely connects the two table supports and the clip to the underside of the table without hardware. Assembly simply requires a hammer or other similar tool to drive the three pieces within the female dovetail cavity. The elongated support, legs, table supports, clip and tabletop are made of wood, optionally solid wood or plywood.

In certain aspects a kit for a table is provided with a container containing a plurality of flat parts with a majority of their surfaces configured as flat and planar, the plurality of flat parts include an elongated support (stretcher), a table top, a plurality of legs and a plurality of table supports and the container further containing fasteners, preferably a clip is also provided. At least three of the plurality of flat parts have surfaces facing and arranged parallel another of the plurality of flat parts when the plurality of flat parts are contained in the container. Each of the legs include a hole at an end thereof and the elongated support including at least one hole therein, one of the fasteners configured to secure through the hole in two of the legs and the hole in the elongated support such that the legs extend downwards and outwards at an angle apart from the elongated support. The table supports define a recess with two internal facing edges which are outwardly tapered at an angle which cooperates with the angle of the legs such that each internal facing edge is configured to abut and align one of an outwards facing surface of one the legs. The table top is configured to rest on top of the table support.

In certain aspects the elongated support has a plurality of notches therein adjacent the hole in the elongated support such that one notch is on each side of the hole in the elongated support and such that ends of two of the plurality of legs are configured to insert at least partially into the respective notches when secured to the elongated support with the fastener. In other aspects the table top includes a plurality of notches therein which extend at least partially into a bottom surface of the table top, a first one of the plurality of notches aligned and sized to receive part a first one of the table supports and a second one of the plurality notches aligned and sized to receive part of a second one of the table supports, the first and second ones of the plurality of notches are parallel each other. In still other aspects a maximum thickness of the container is less than 3 inches with the plurality of flat parts and fasteners contained therein. In still other aspects a maximum thickness of the container is less than 2 inches with the plurality of flat parts and fasteners contained therein. In still other aspects the table support includes an upper edge and an edge below the upper edge positioned between the two internal facing edges such that a portion of material exist between the upper edge and the edge below the upper edge to connect two sides of the table support such that each one of the two sides includes one of the two internal facing edges.

In certain other aspects a table is provided including an elongated support with a longitudinal axis and two outwards facing parallel surfaces. A plurality of legs extend outwards and downwards at a first angle relative the elongated support, the legs including holes at ends thereof and the legs connected to the elongated support with fasteners which pass through holes in the ends of the legs and through the elongated support. A table top rests above the elongated support and the plurality of legs and at least one table support is connected to the table top to define a recess with internal facing edges which are outwardly tapered at a second angle which is substantially equal the first angle such that each internal facing edge abuts one of an outwards facing surface of one the legs.

In certain aspects the plurality of legs includes first, second, third and fourth legs. The elongated support includes two holes spaced apart and the first and second legs are secured to a first one of the two holes on either side of the first one of the holes. The third and fourth legs are secured to a second one of the two holes on either side of the second one of the two holes. In certain aspects four notches are in the elongated support, each notch located around one of the two holes with two of the four notches in one of the two outwards facing parallel surfaces and another two of the four notches in another one of the two outward facing parallel surfaces. In still other aspects a bottom surface of the table top is spaced with respect to an upper edge of the elongated support. In still other aspects a bottom surface of the table top includes recesses therein with at least one undercut surface defining a widening portion of the recess from the bottom surface towards the top surface of the table top. The table support has a holding portion which widens from an intermediate position towards a top edge of the table support such that the top edge of the table support when installed in the recess is between the top and bottom surfaces of the table top and the table support and table top are held together by interaction between the at least one undercut surface and the holding portion. In certain other aspects the holding portion comprises a plurality of holding portions spaced along an upper portion of the table support and the recess includes a plurality of undercut surfaces spaced apart such that between two undercut surfaces, the recess defines a surface perpendicular the bottom surface of the table top.

Other objects of the invention and its particular features and advantages will become more apparent from consideration of the following drawings, claims and accompanying detailed description.

The terms "first" and "second" are used to distinguish one element, set, data, object or thing from another, and are not used to designate relative position or arrangement in time.

DETAILED DESCRIPTION OF THE INVENTION

Figure 1:
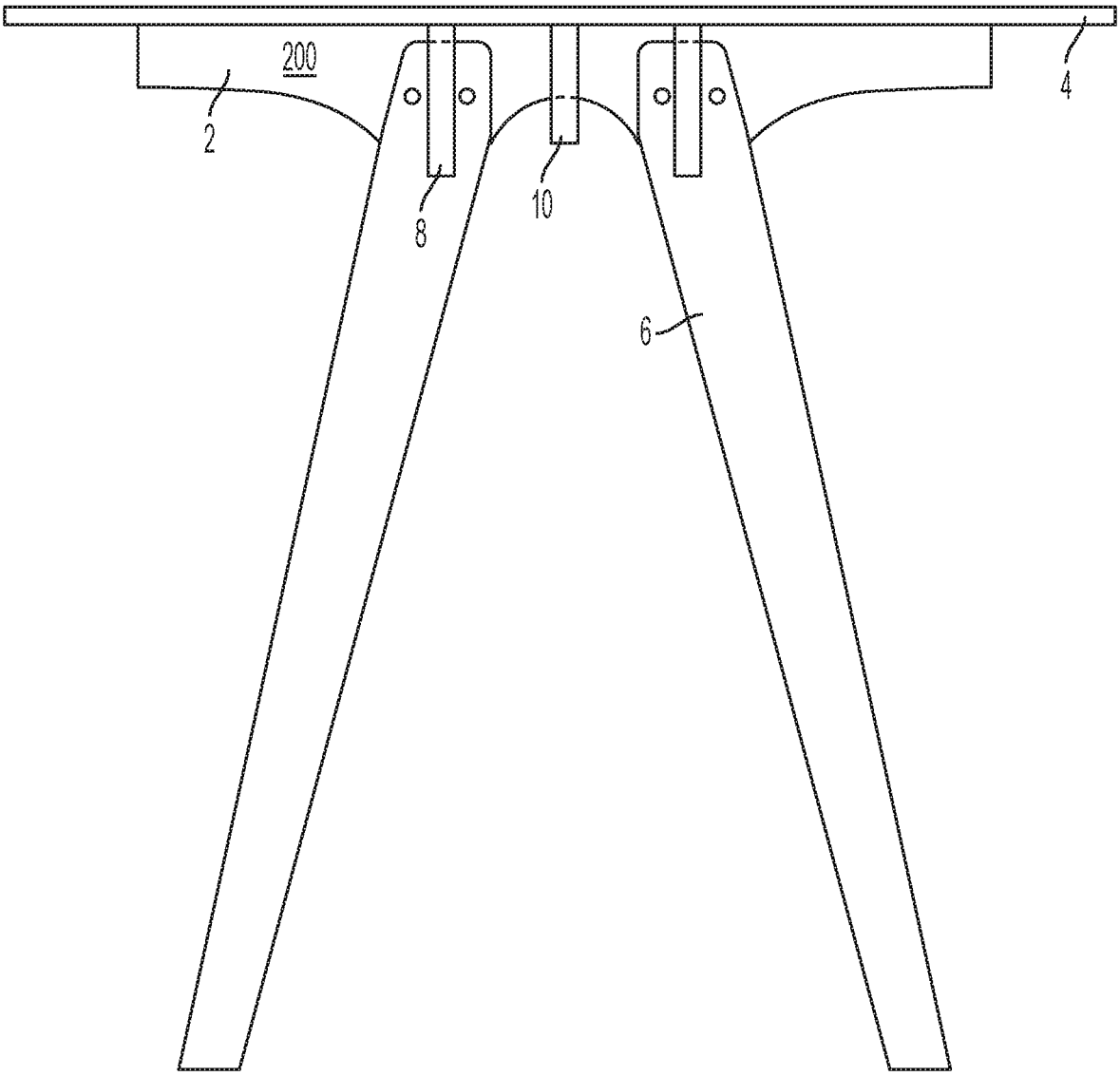
FIG. 1 is a side view of the table according to the present invention.

Referring now to the drawings, wherein like reference numerals designate corresponding structure throughout the views. The following examples are presented to further illustrate and explain the present invention and should not be taken as limiting in any regard.

The table shown is generally a sawhorse style table. An elongated member or stretcher 2 has legs 6 attached thereto. The legs extend downward and outward at a compound angle of 5-25 degrees, preferably 15 degrees with respect to the center of the table. As shown the legs extend outward in the left/right direction from the view of FIG. 1 and also extend outward with respect to the parallel surfaces 200 of the elongated member (left/right with respect to FIG. 2). The table top 4 rests on top of the elongated member 2 and table supports 8 inhibit tilting of the table top about the axis of the elongated member. The elongated member inhibits tilting of the table top about an axis which extends out of the page with respect to FIG. 1. Clip 10 is provided to inhibit the table top 4 from being separated from the elongated member 2 in an upward direction with respect to FIG. 1. The holes shown in FIG. 1 are through holes which extend through the legs 6 on either side and through the elongated member 2. Nuts/bolts are provided to secure the legs to the elongated member 2 via these holes.

Figure 2:
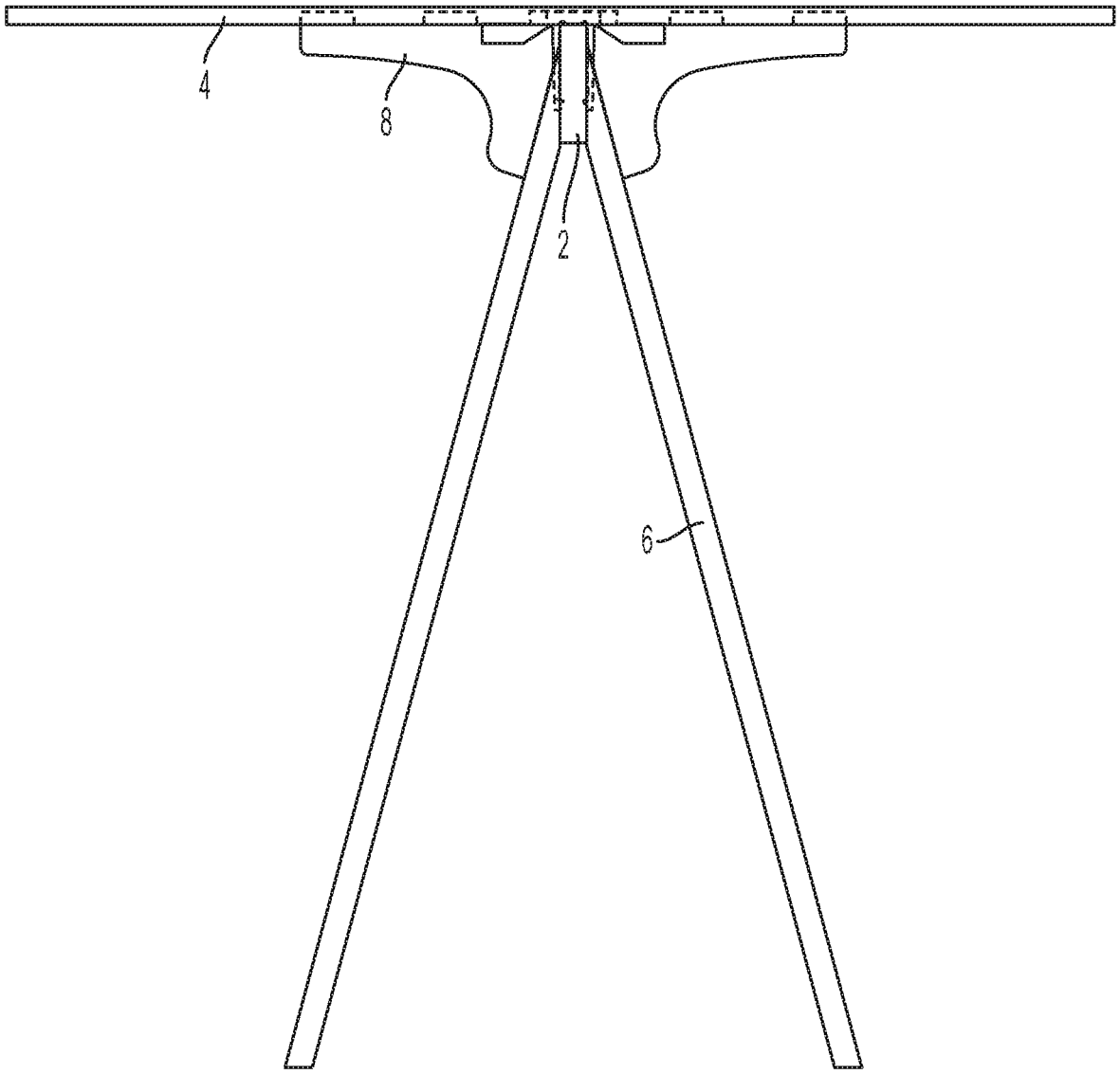
FIG. 2 is a front view of FIG. 1.
Figure 3:
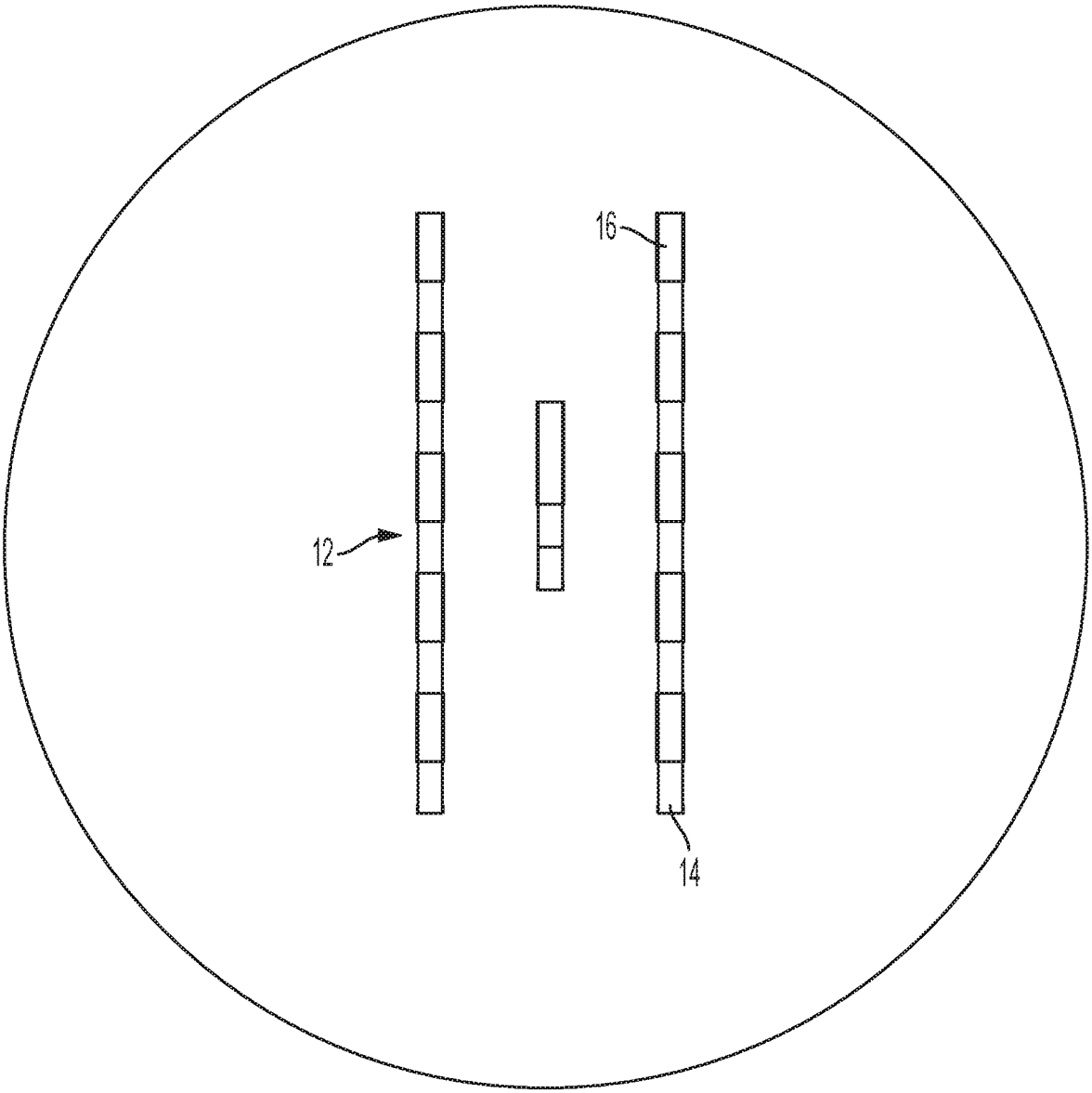
FIG. 3 is a bottom view of the table top of FIG. 1.
Figure 4:
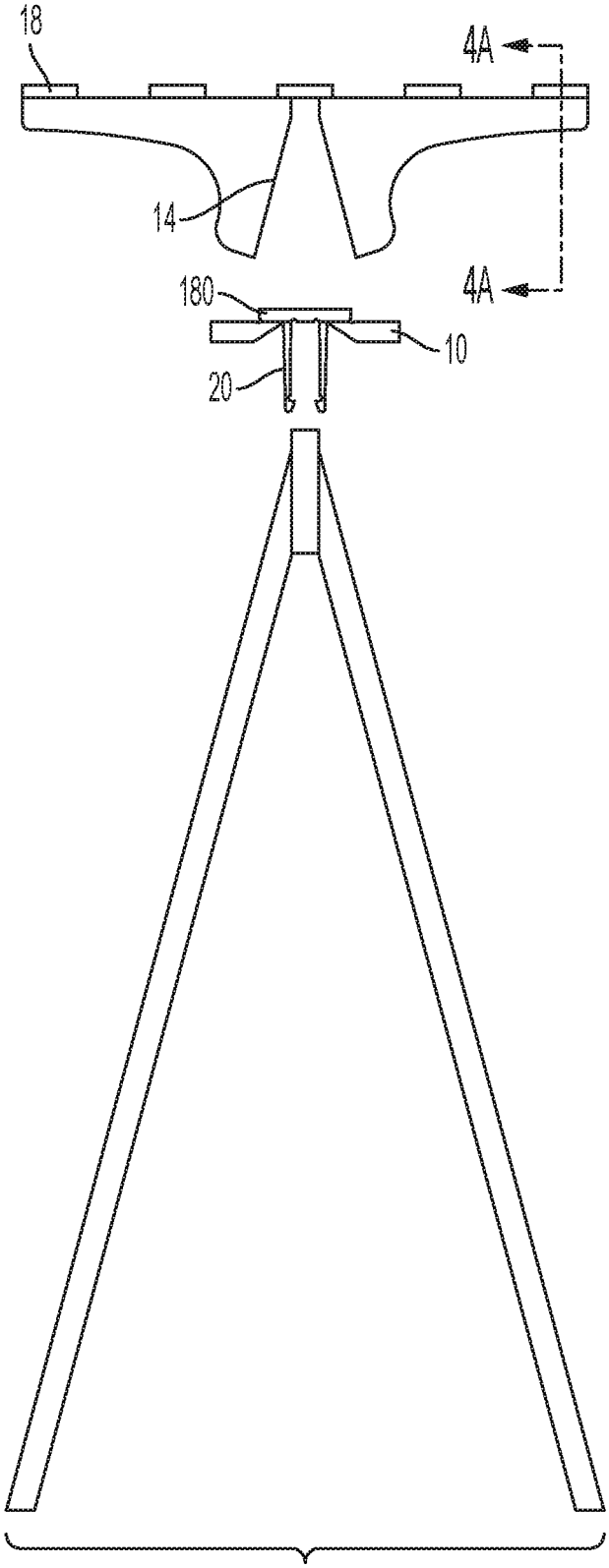
FIG. 4 is a front partial exploded view of FIG. 1.
Figure 4A:
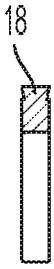
FIG. 4A is a section view along line 4A in FIG. 4.

FIGS. 2 and 4 show additional detail on the table supports 8 which as can be seen include fingers 18 which widen as they extend upwards. These fingers 18 may be also be considered dovetails. As shown, these portions of the table supports 8 or fingers are tapered 18 and multiple ones of these fingers are provided on the top of the table support 8 in a spaced relationship, preferably at least two fingers are provided and even more preferably at least three are provided. The table top includes recesses 12 as shown in FIG. 3. These recesses include wider section 16 and undercut sections 14 in an alternating fashion. The fingers 18 are first inserted to align with the wider sections 16 which include generally vertical walls (out of the page) and then with the top edge of the fingers 18 abutting the corresponding surface in the recess, the fingers 18 are slid to interact with undercuts 14 which are tapered or widened walls designed to match the shape of fingers 18. Once slid, the fingers then are retained by the undercut in the sense that the fingers cannot be pulled out of the recess in the vertical direction (out of the page with respect to FIG. 3). The center recess shown in FIG. 3 is shorter but is designed to receive finger 180 of the clip 10. This clip includes lower fingers 20 and catches which secure under the elongated support 2 to inhibit the table top and table support assembly from being separated vertically from the elongated support 2. Finger 180 also widens much like finger 18 and the center recess includes the undercut 14 and wider 16 sections of the longer recesses in the table top. Although fingers 18/180 are shown with tapered surfaces, it is contemplated that other widening configurations could be used to create a joint.

The table support 8 is shown with a central recess delimited by tapered walls 14. These tapered walls are at an angle that matches the outward taper of the legs 6 so that once assembled, the tapered walls 14 abut the outer surfaces of the legs 6. As can be seen, the central recess is a through recess all the way through the table support 8.

Figure 5:
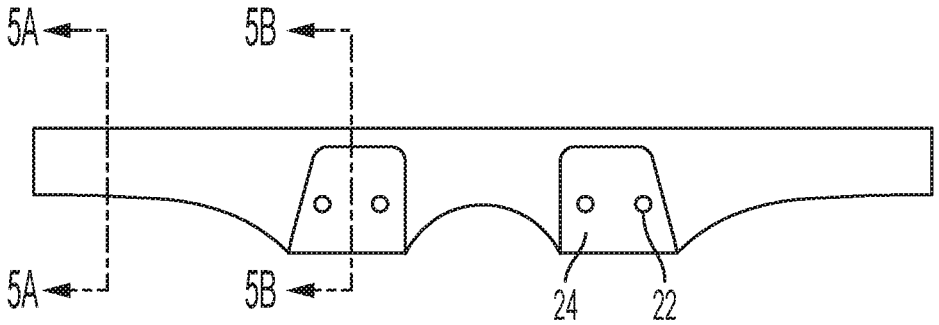
FIG. 5 is a side view of part of the table of FIG. 1.
Figure 5A:
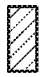
FIG. 5A is a section view along line 5A in FIG. 5
Figure 5B:
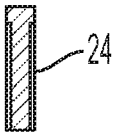
FIG. 5B is a section view along line 5B in FIG. 5.
Figure 6:
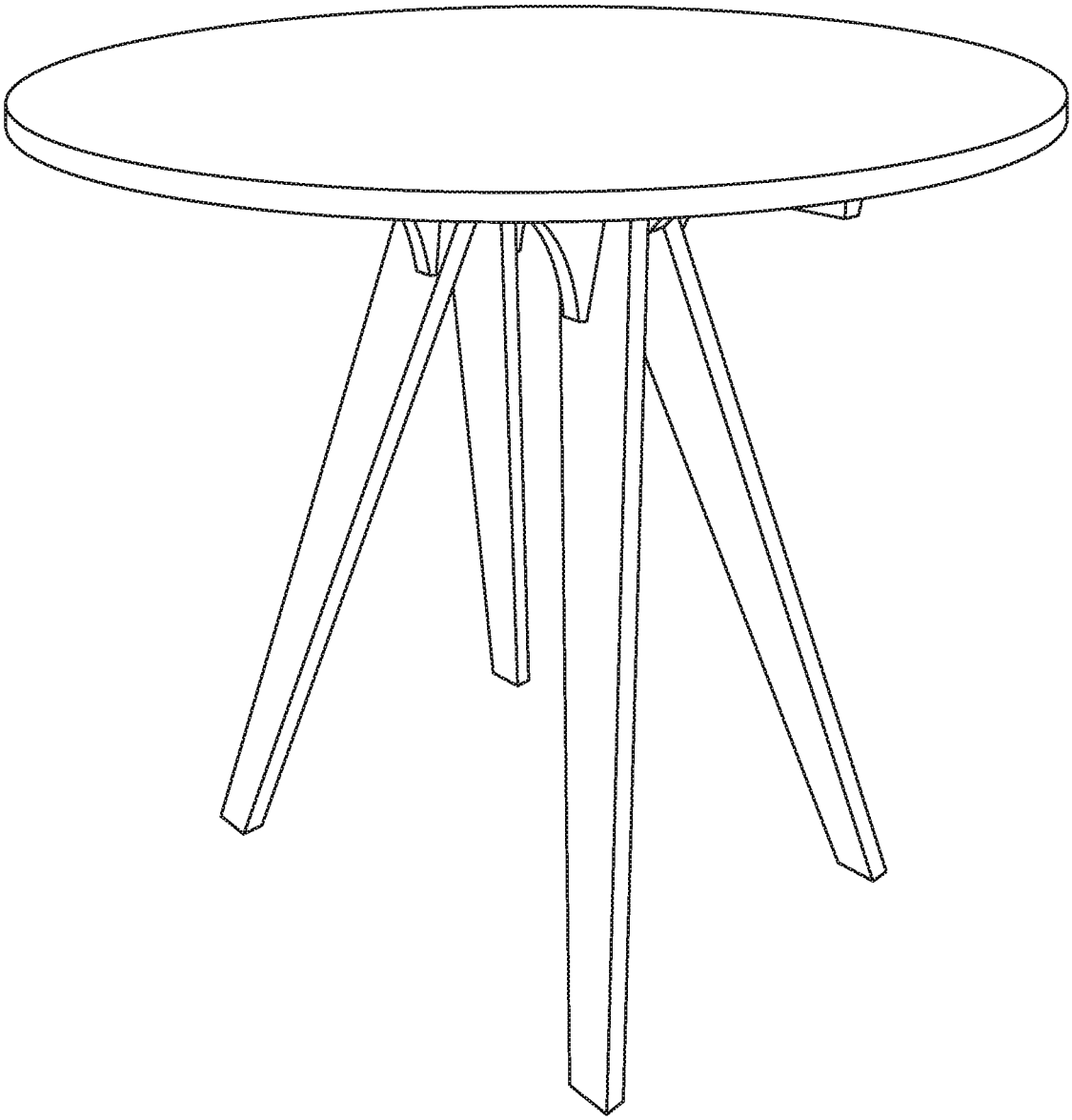
FIG. 6 is a perspective view of the table of FIG. 1
Figure 7:
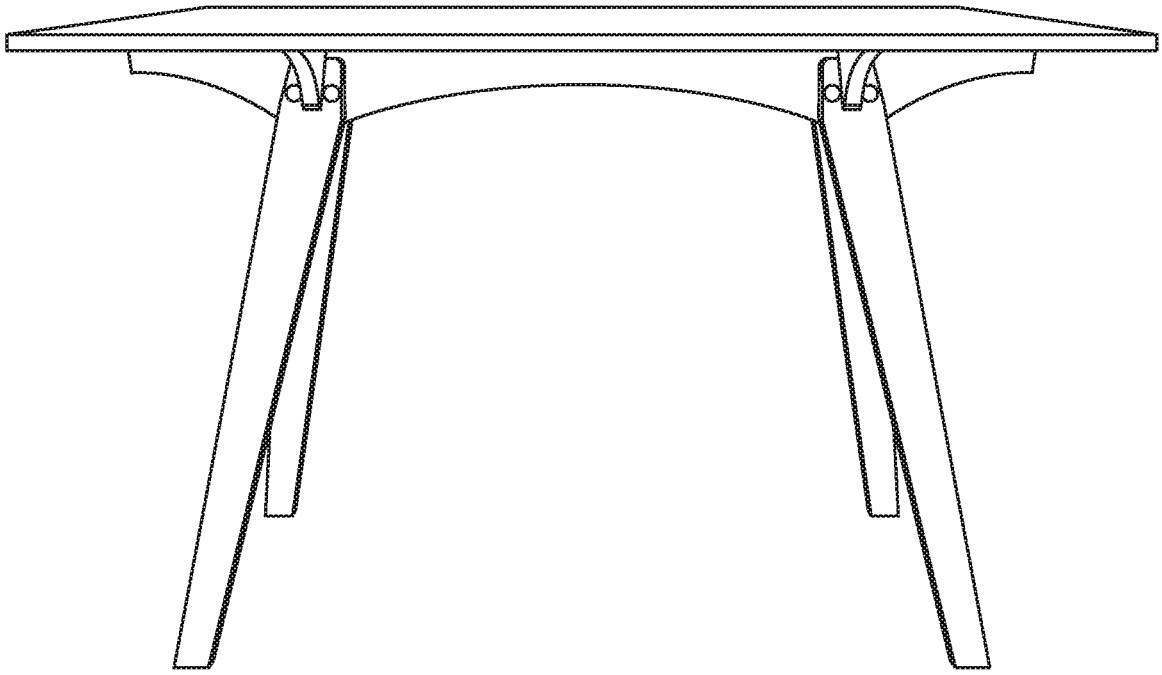
FIG. 7 is a perspective view of a table similar to that of FIG. 1 but with a different shaped top.

Referring to FIGS. 5, 5A and 5B, additional detail on the interface between the legs 6 and the elongated support 2 is shown. Recess or notch 24 which extends part way into the elongated support 2 is provided and shaped to match the upper end of the legs. Each of the notches narrows in a direction from a bottom edge of the elongated support towards a top edge of the elongated support as see in in FIG. 5. Holes 22 are provided to align with the corresponding holes in the legs. The end of the leg which fits into the notch 24 is cut at an angle to provide the outward angle of the leg as shown in FIG. 2. The angle from this perspective is preferably in the range of 1-20 degrees, more particularly 5-20 degrees, even more particularly 10-20 and preferably 15 degrees. The shape of the notch 24 and the end of the leg are provided to define the outward angle of the leg as shown in FIG. 1. The angle from this perspective is preferably in the range of 1-20 degrees, more particularly 5-20 degrees, even more particularly 10-20 and preferably 15 degrees. Accordingly, a compound angle is created. As can be seen in FIG. 1 the leg extends outward at a non-zero angle and the table support 8 is generally vertical.

Figure 8:
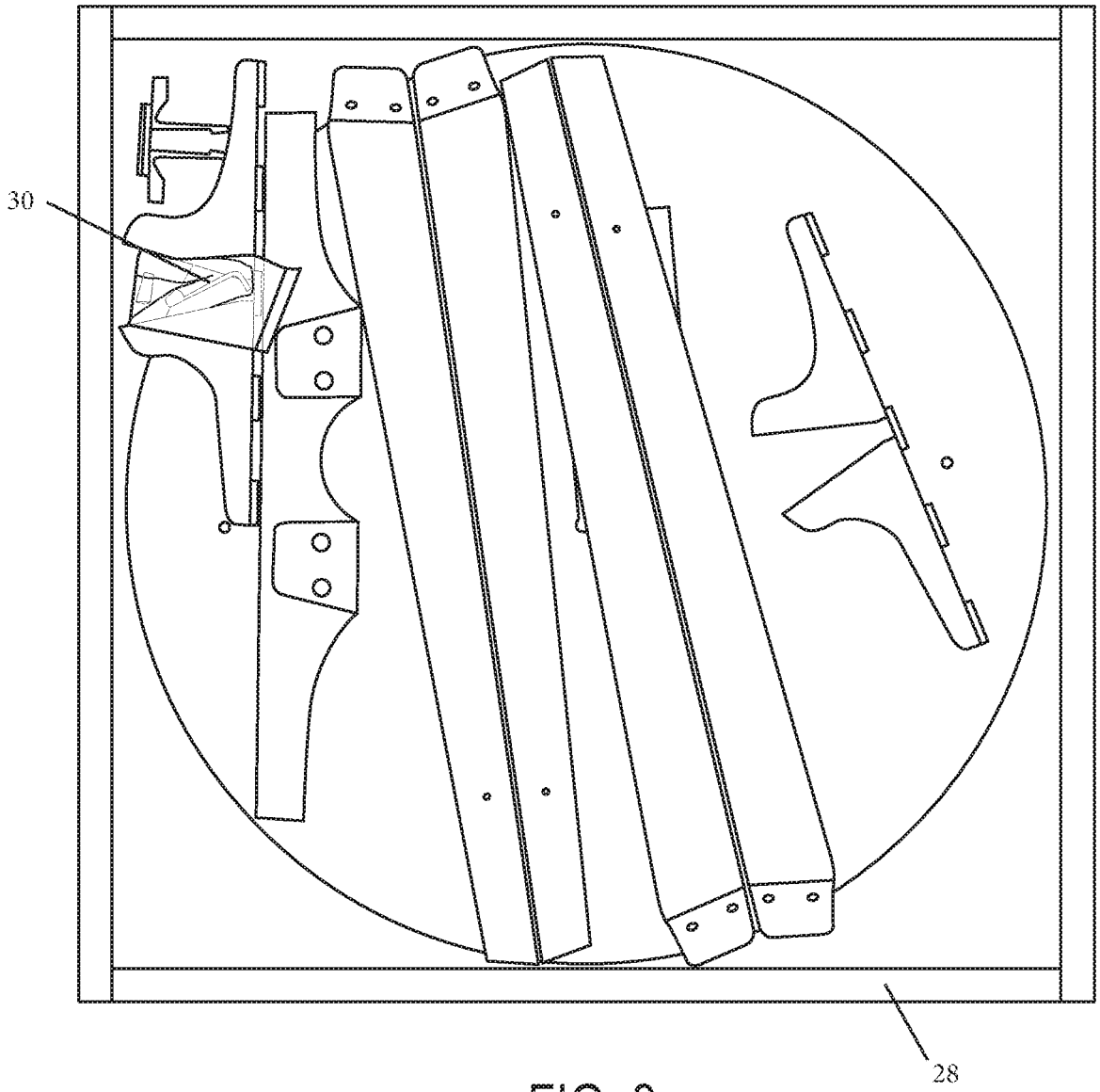
FIG. 8 is a top view of the table kit of FIG. 1 disassembled and in packaging.
Figure 9:
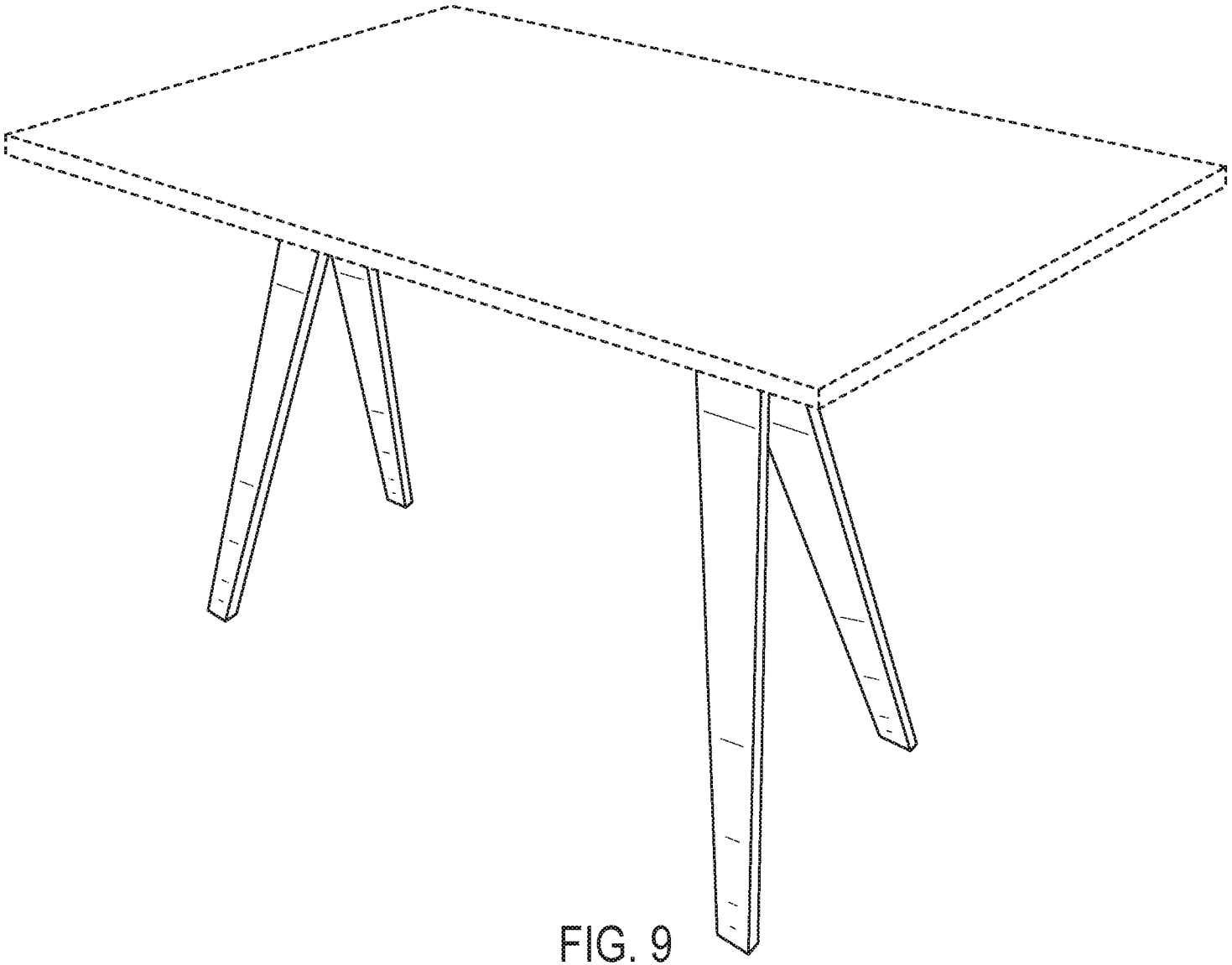
FIG. 9 is a perspective view of one ornamental design for a table.
Figure 10:
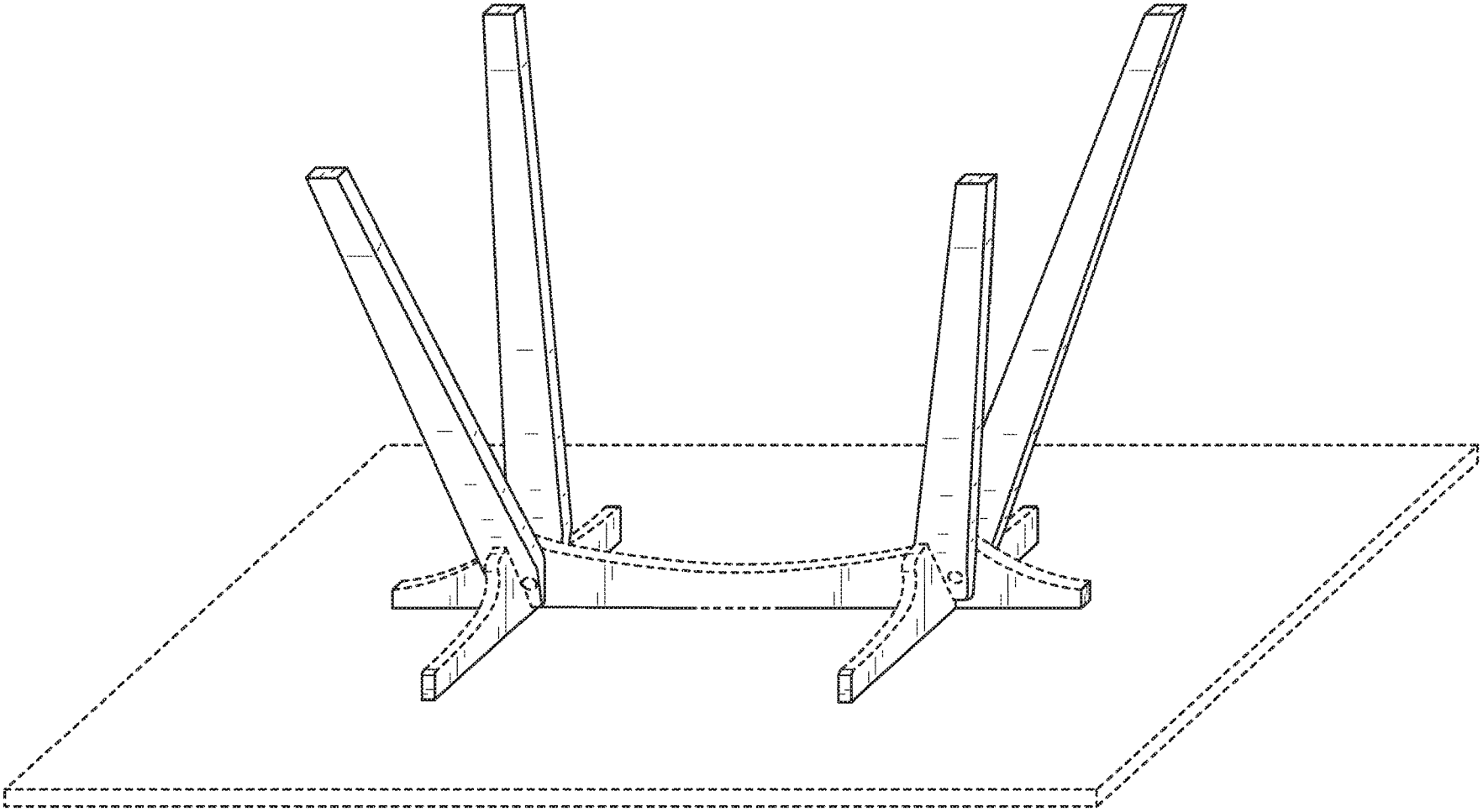
FIG. 10 is a bottom perspective view of FIG. 9.
Figure 11:
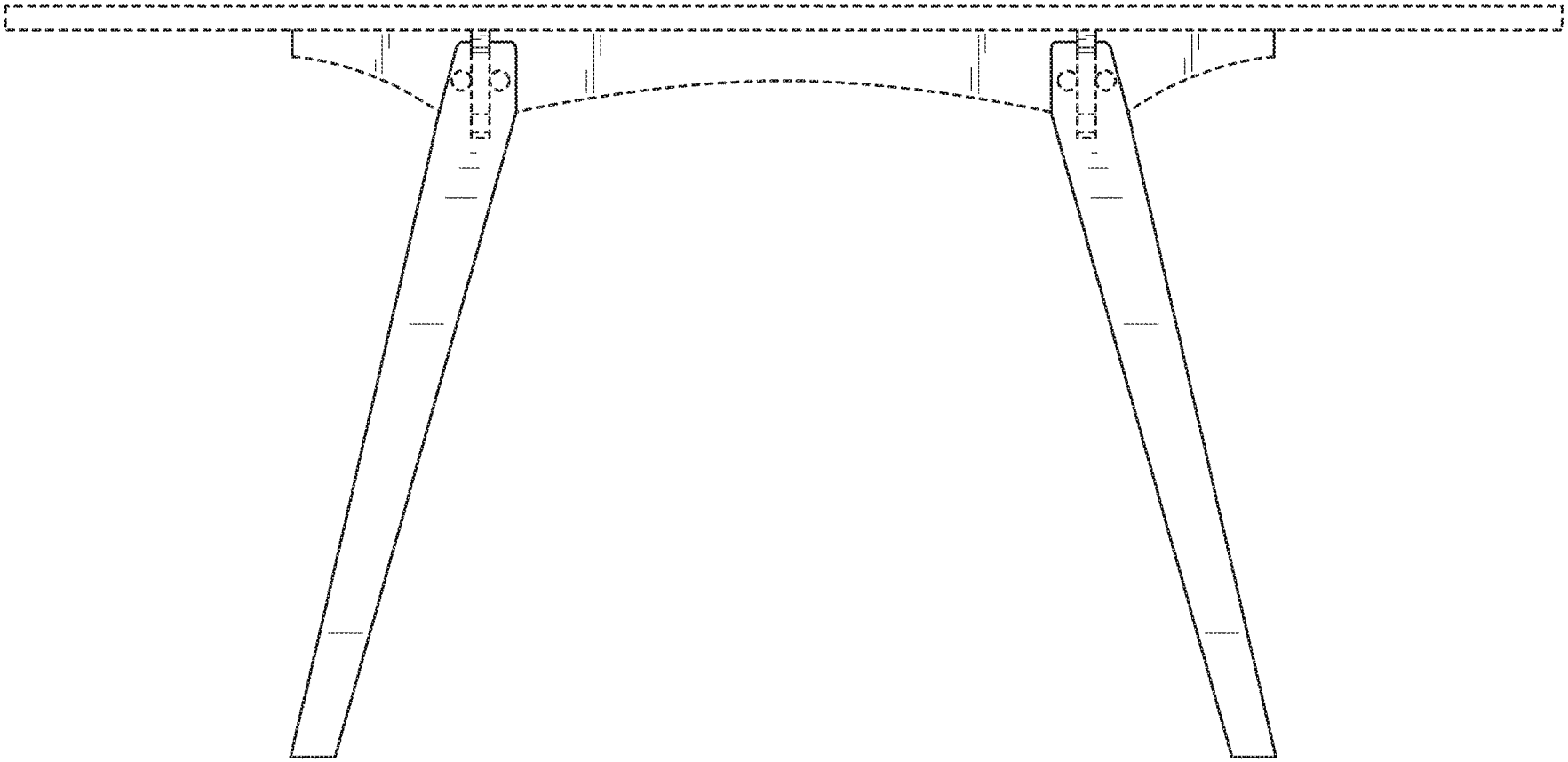
FIG. 11 is a right side view of FIG. 9.
Figure 12:
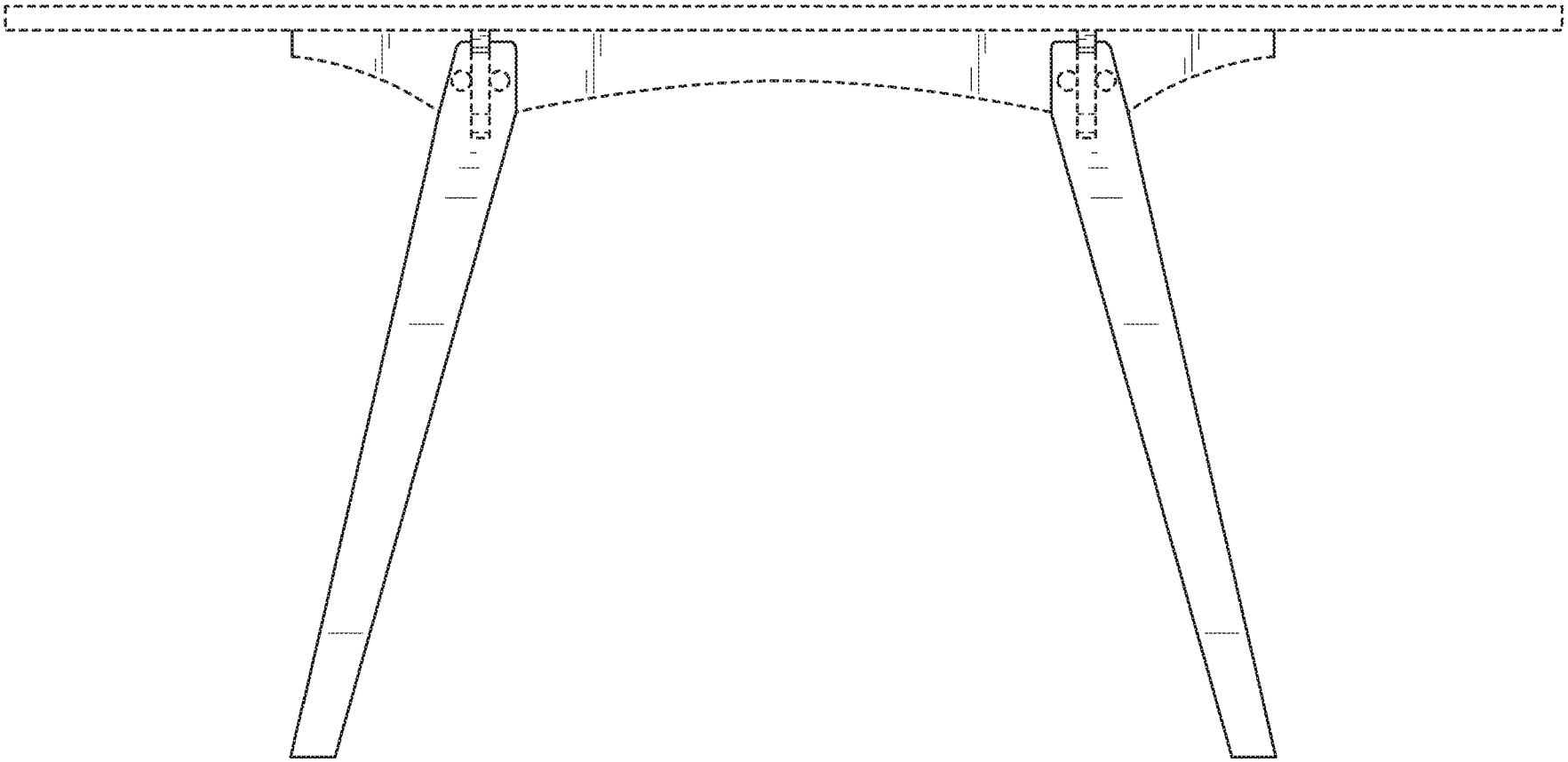
FIG. 12 is a left side view of FIG. 9.
Figure 13:
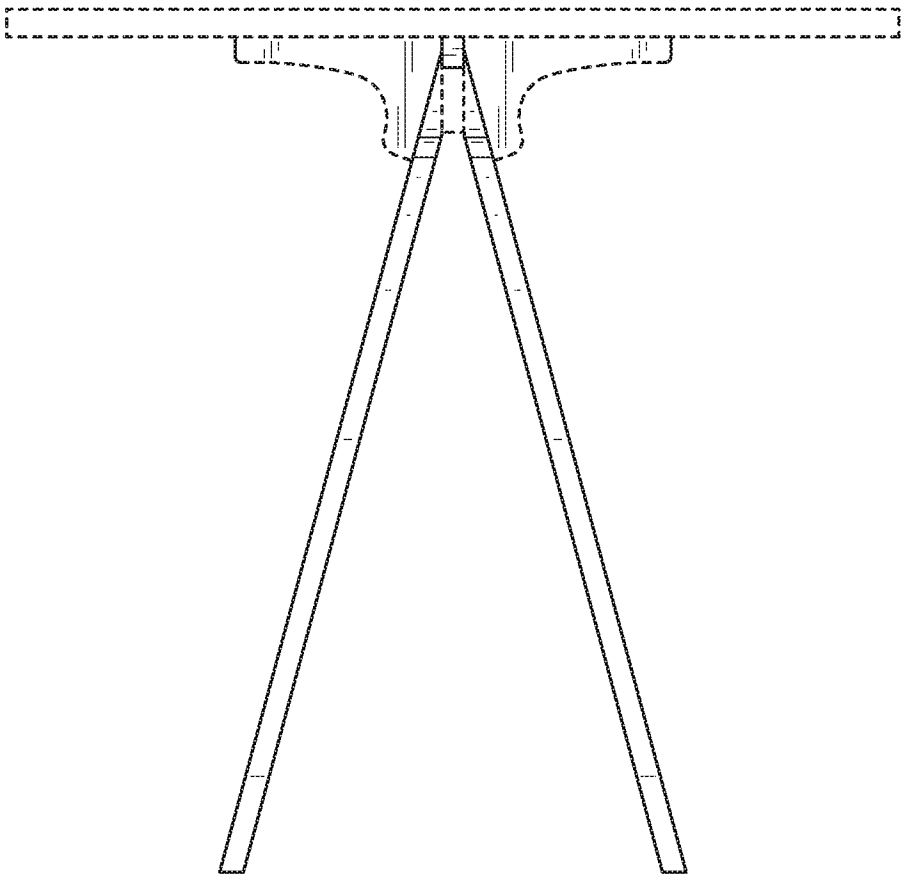
FIG. 13 is a front view of FIG. 9.
Figure 14:
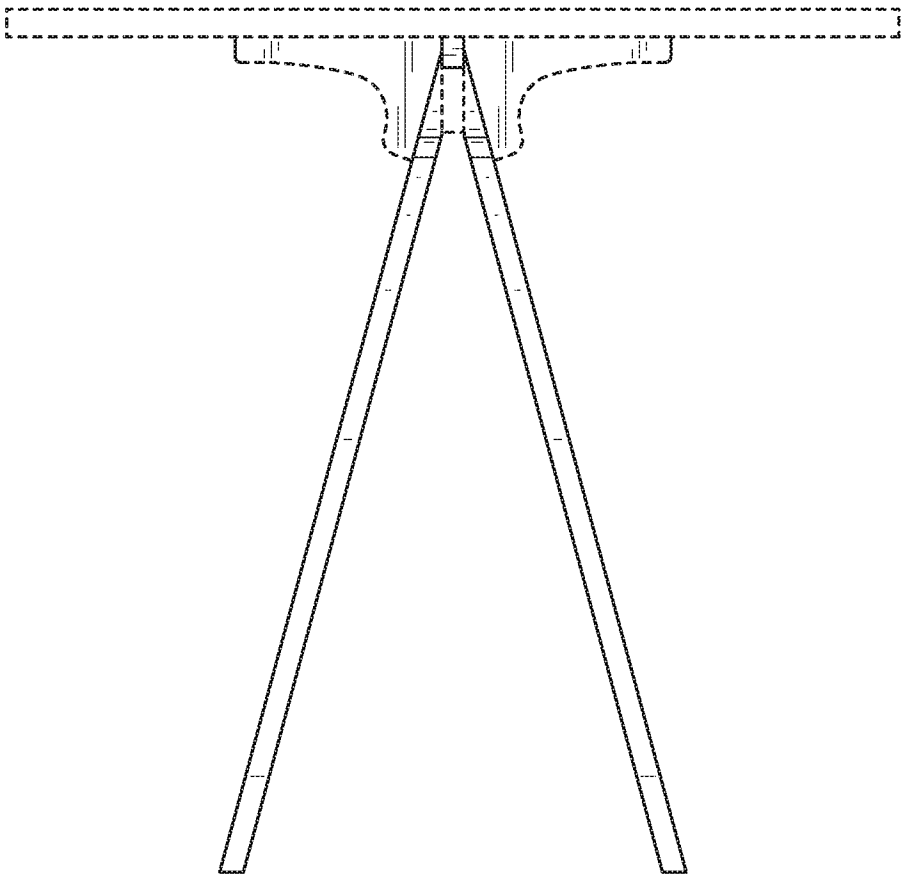
FIG. 14 is a rear view of FIG. 9.
Figure 15:
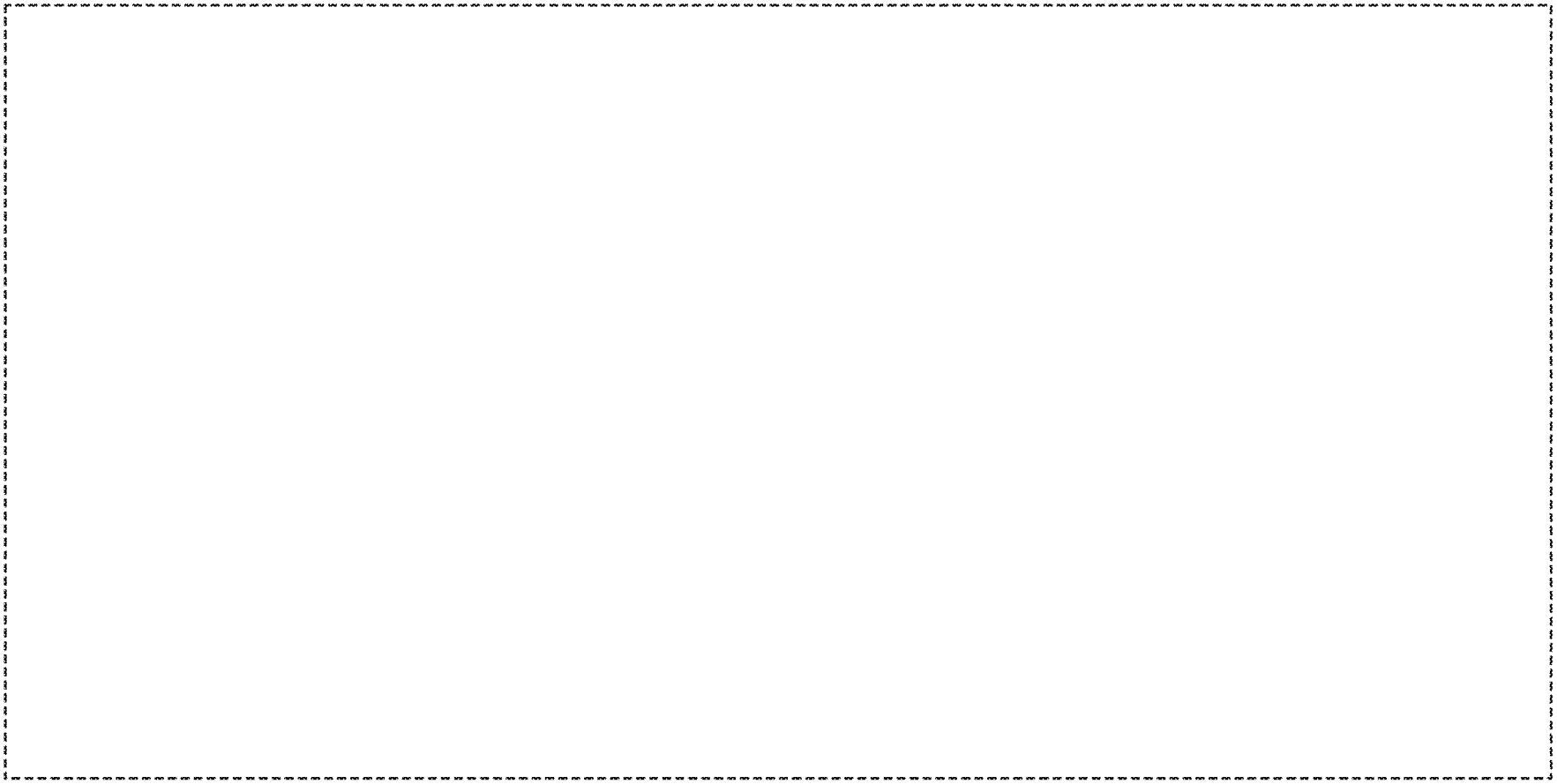
FIG. 15 is a top view of FIG. 9.
Figure 16:
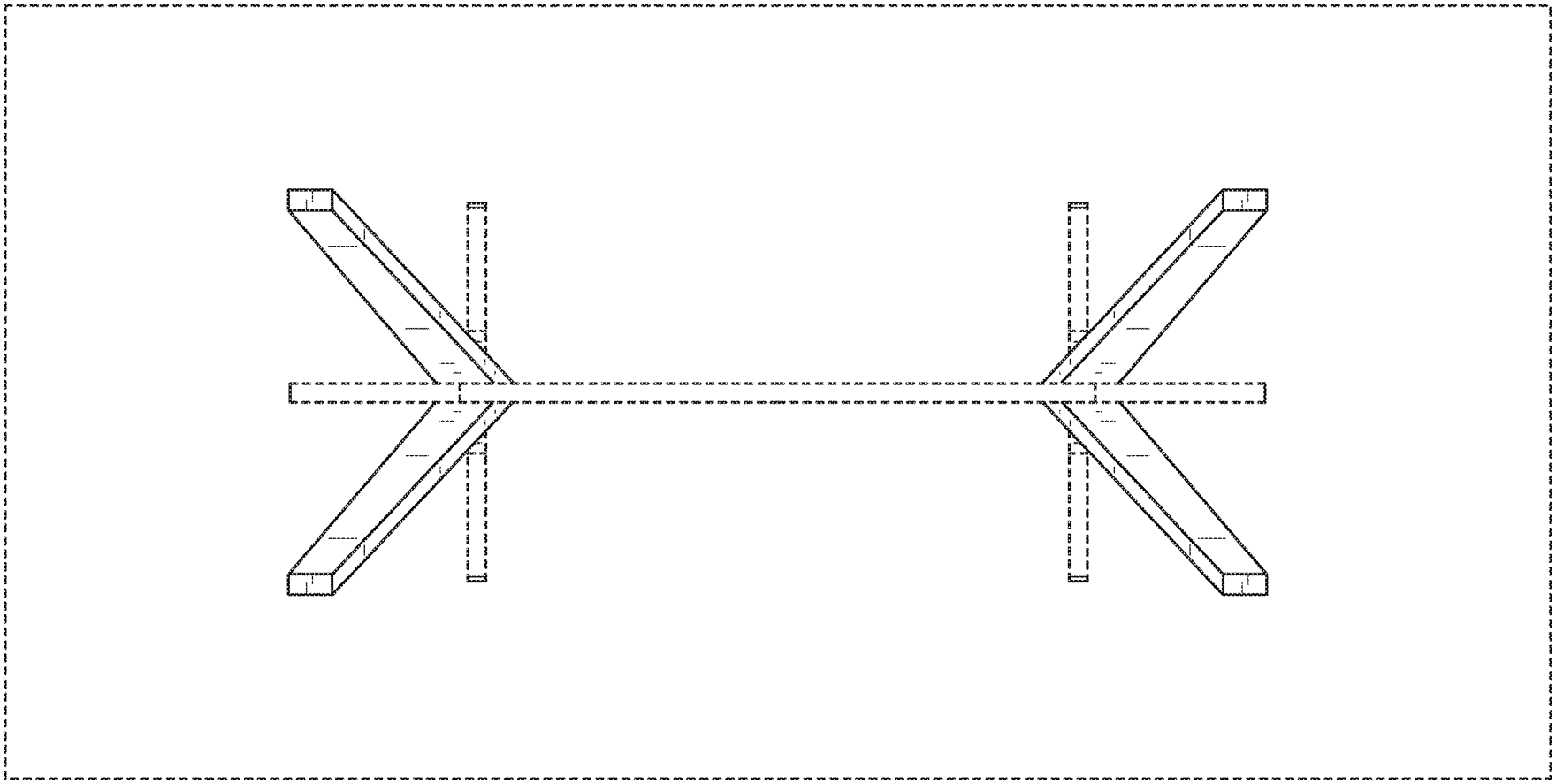
FIG. 16 is a bottom view of FIG. 9.

Referring to FIG. 8, the table is shown disassembled and inside packaging 28. As shown, the various parts of the table are arranged within a square package with the table top on the lower level as shown and the other components such as the various supports and legs etc. arranged on top of the table. In this manner, the thickness of the package is twice the thickness of the legs or the sum of the legs and table top thickness with an additional 5-40% of that sum. For example, if the legs and table are made of ¾ inch plywood, the overall package thickness would be roughly 2 inches or less. Also shown in the package is a bag containing hardware such as bolts/screws that allow the legs to attach in the manner shown in previous figures. In preferred embodiments, the screws/bolts utilize a hex head and an appropriately sized hex wrench is provided. However, the wrench is shown with an angle between its ends of greater than 90 degrees. Particularly, the angle of the wrench would be 90 degrees plus the outward angle of the legs as depicted from the view in FIG. 2. In this manner, the wrench when spun will not interfere/hit the legs during the process of tightening down the bolts/screws.

Within the figures, FIGS. 9-16 represent one ornamental design contemplated by the inventors and within the scope of the disclosure herein. It is contemplated by the inventors that the broken lines would represent unclaimed features in a prospective ornamental design application and specifically contemplated by the inventors that any combination or portions of the broken lines could be changed to solid lines to vary the scope of the claim. It is also contemplated by the inventors that the rectangular top shown in broken lines could be exchanged for a different shaped top such as the round top shown in FIGS. 1-8 (whether in broken or solid lines).

Although the invention has been described with reference to a particular arrangement of parts, features and the like, these are not intended to exhaust all possible arrangements or features, and indeed many other modifications and variations will be ascertainable to those of skill in the art.

What is claimed is:

1. A support kit comprising:

an elongated support with a longitudinal axis, two elongated end surfaces and two outwards facing parallel surfaces which are larger than the two elongated end surfaces and at least two holes spaced apart;

a plurality of legs configured to extend outwards and downwards at a first angle relative the elongated support, the legs including holes at ends thereof and the legs are configured to connect to the elongated support with fasteners which pass through holes in the ends of the legs and through the elongated support;

a plurality of notches in the elongated support, each notch located around one of the two holes with at least two of the plurality of notches in one of the two outwards facing parallel surfaces, each of the plurality notches narrows in a direction from a bottom edge of the elongated support towards a top edge of the elongated support.

2. The kit of claim 1 wherein the plurality of notches comprises at least four notches with at least two of the plurality of notches in another one of the two outward facing parallel surfaces and wherein the plurality of legs comprises at least four legs, each of the at least four legs fits at least partially into one of the at least four notches.

3. The kit of claim 1 configured to support a table top to create a table further comprising:

the table top which rests above the elongated support and the plurality of legs;

at least one table support configured to connect to the table top to define a recess with internal facing edges which are outwardly tapered wherein each internal facing edge is configured to abut one of an outwards facing surface of one the legs.

4. The kit of claim 1 wherein the fasteners include bolts.

5. The kit of claim 1 wherein at least one of the plurality of notches is defined by a vertical portion and a tapered portion.

6. The kit of claim 1 wherein each of the plurality of notches includes two holes.

7. The kit of claim 1 wherein the elongated support and the plurality of legs are made from plywood.

8. The kit of claim 1 wherein least two of the holes through the elongated support are located in each of the plurality of notches and each of the plurality of legs has two holes therethrough.

9. The kit of claim 8 wherein the fasteners comprise at least two fasteners for each of the plurality of legs, each fastener passing through one of the holes in the elongated support which are located at the notches and through one of the holes in at least two of the plurality of legs.

10. The kit of claim 1 wherein one of the two elongated end surfaces includes a curved portion.

11. A table kit comprising:

an elongated support with a longitudinal axis and two parallel outward facing surfaces;

a plurality of legs configured to connect to the elongated support so that each leg extends outwards and downwards at a first angle;

a table top which is configured to rest above the elongated support and the plurality of legs;

a plurality of table supports separate from and configured to connect to the table top to define a recess with two internal facing edges which are outwardly tapered at a second angle which is substantially equal the first angle such that each internal facing edge abuts one of an outwards facing leg surface of one the legs, the outwards facing leg surface arranged parallel the longitudinal axis and the internal facing edges extending between first and second surfaces of the table support, the first and second surfaces being parallel and outward facing in opposite directions.

12. The kit of claim 11 further comprising:

at least one hole extending through the elongated support;

a recess in the elongated support on each side of the at least one hole wherein the legs secure to the elongated supports with fasteners which pass through, in order, a hole in a first one of the legs, a first one of the at least one hole in the elongated support and a hole in a second one of the legs, wherein ends of the first and second legs are at least partially contained in recesses of the elongated support on opposite sides of the first one of the at least one hole in the elongated support.

13. The kit of claim 12 wherein the at least one hole includes two holes spaced apart along the elongated support and the plurality of legs include third and fourth legs configured to secure to a second one of the two holes in the elongated support, wherein the elongated support includes recesses on either side of the second one of the two holes and the third and fourth legs secure to the elongated support with a fastener which passes through, in order, a hole in the third one of the legs, the second one of the two holes in the elongated support and a hole in the fourth one of the legs, wherein ends of the third and fourth legs are at least partially contained in recesses of the elongated support on opposite sides of the second one of the two holes in the elongated support.

14. The kit of claim 12 wherein the ends of the first and second legs include angled faces which are positioned at an angle relative the outwards facing surface that the internal facing edge of one of the table supports which abuts the corresponding leg, wherein the angle relative the outwards facing surface is equal to the second angle of the internal facing edge.

15. The kit of claim 11 wherein the table top further comprises:

a plurality of notches therein which extend at least partially into a bottom surface of the table top;

a first one of the plurality of notches aligned and sized to receive part of the elongated support therein; and at least a second one of the plurality of notches arranged transverse the first one of the plurality of notches and sized to receive at least part of one of the table supports therein along an outer edge of the table support.

16. The kit of claim 11 further comprising a plurality of notches in the elongated support, each notch located around one of the two holes with at least two of the plurality of notches in one of the two outwards facing parallel surfaces, each of the plurality notches narrows in a direction from a bottom edge of the elongated support towards a top edge of the elongated support.

17. The kit of claim 11 wherein the elongated support, plurality of legs, the plurality of table supports and the table top are made of plywood.

18. The kit of claim 11 wherein the recess of the plurality of table supports includes a flat upper edge and a flat lower edge parallel the upper edge, the flat lower edge positioned between the internal facing edges such that the internal facing edges extend downward and away from the flat upper edge.

19. A kit for a table comprising:

a container containing a plurality of flat parts with a majority of their surfaces configured as flat and planar, the plurality of flat parts including an elongated support, a table top, a plurality of legs and a plurality of table supports wherein each of the plurality of flat parts is a separate part from others of the plurality of flat parts;

the container further containing fasteners, wherein at least three of the plurality of flat parts have surfaces facing and arranged parallel another of the plurality of flat parts when the plurality of flat parts are contained in the container;

each of the legs including a hole at an end thereof and the elongated support including at least one hole therein, one of the fasteners configured to secure through the hole in two of the legs and the hole in the elongated support such that the legs extend downwards and outwards at an angle apart from the elongated support;

the table supports defining a recess with two internal facing edges which are outwardly tapered at an angle which cooperates with the angle of the legs such that each internal facing edge is configured to abut and align one of an outwards facing surface of one the legs;

the table top configured to rest on top of the table support.

20. The kit of claim 19 further comprising a plurality of notches in the elongated support, each notch located around one of the holes in the elongated support with at least two of the plurality of notches in one of the two outwards facing parallel surfaces, each of the plurality notches narrows in a direction from a bottom edge of the elongated support towards a top edge of the elongated support.

21. The kit of claim 19 wherein the table top includes a plurality of notches therein which extend at least partially into a bottom surface of the table top, a first one of the plurality of notches aligned and sized to receive part a first one of the table supports and a second one of the plurality notches aligned and sized to receive part of a second one of the table supports, the first and second ones of the plurality of notches are parallel each other.

22. The kit of claim 19 wherein a maximum thickness of the container is less than 3 inches with the plurality of flat parts and fasteners contained therein.

* * * * *